United States Patent [19]

Maloney

[11] Patent Number: 4,610,190

[45] Date of Patent: Sep. 9, 1986

[54] PITCH RAISING SYSTEM FOR GUITARS

[76] Inventor: Terrance R. Maloney, 607 W. Springfield, Champaign, Ill. 61820

[21] Appl. No.: 663,182

[22] Filed: Oct. 22, 1984

[51] Int. Cl.[4] ..... G10D 3/12

[52] U.S. Cl. ..... 84/312 R; 84/313

[58] Field of Search ..... 84/298, 299, 312, 313

[56] References Cited

U.S. PATENT DOCUMENTS

| | | | |
|---|---|---|---|
| 447,689 | 3/1891 | Lenzner | 84/298 |
| 775,327 | 11/1904 | Burchit | 84/313 |
| 1,723,767 | 8/1929 | Corwin | 84/313 X |
| 3,081,662 | 3/1963 | Retter | 84/298 |
| 3,411,394 | 11/1968 | Jones | 84/313 |
| 3,990,341 | 11/1976 | Pace | 84/313 |
| 4,064,780 | 12/1977 | Bond | 84/314 R |

*Primary Examiner*—Lawrence R. Franklin

[57] ABSTRACT

The invention is a pitch raising system for a guitar providing mechanical means to produce musical techniques usually performed manually (tremolo, pitch raising and tremolo of raised pitches). The preferred mode of the system includes a pitch raising device, wear resistant links, wear resistant bridge elements and an upper stop. The E, B and G strings are attached to a pivoting structure pulling it taut horizontally to the surface of the body of the guitar.

The parts of the pitch raising device are each designed so that when assembled, the points of string attachment are adjustable within a single geometric plane with the axis of the pivoting structure. The links are joined to the pivoting structure by U-shaped rods. The U-shaped rods are longitudinally adjusted to tune the strings in relationship with each other for when the device is in raised position. They are then clamped tightly in place. The bridge elements include a high wear resistant rod at the point of string contact. The upper stop blocks the handle of the pitch raising device rather than its pivoting structure.

7 Claims, 11 Drawing Figures

Y AXIS
X AXIS
A'
A
B
G
E
FIRST QUADRANT
FOURTH QUADRANT
SECOND QUADRANT
THIRD QUADRANT
C
F
D
H

PITCH RAISING SYSTEM FOR GUITARS

U.S. Patent Documents Cited

| | | | |
|---|---|---|---|
| 2,949,806 | 8/1960 | TURMAN | 84/313 |
| 4,285,262 | 8/1981 | SHOLZ | 84/313 |
| 3,411,394 | 11/1968 | JONES | 84/313, 84/312R |
| 4,170,161 | 10/1979 | KAFTAN | 84/313, 84/312R |

FIELD OF INVENTION

The invention relates to stringed instruments, more particularly to devices for changing the tuning of the strings 312R including: fastenings 297R, bridge 298 and tremolo devices 313.

SUMMARY OF THE INVENTION

The invention is a pitch raising system for a guitar providing mechanical means to produce musical techniques usually performed manually (tremolo, pitch raising and tremolo of raised pitches). The preferred mode of the system includes a pitch raising device, wear resistant links, wear resistant bridge elements and an upper stop. The E, B and G strings are attached to a pivoting structure pulling it taut horizontally to the surface of the body of the guitar.

The parts of the pitch raising device are each designed so that when assembled, the points of string attachment are adjustable within a single geometric plane with the axis of the pivoting structure. The links are joined to the pivoting structure by U-shaped rods. The U-shaped rods are longitudinally adjusted to tune the strings in relationship with each other for when the device is in raised position. They are then clamped tightly in place. The bridge elements include a high wear resistant rod at the point of string contact. The upper stop blocks the handle of the pitch raising device rather than its pivoting structure.

DISCUSSION OF PRIOR ART

Jones U.S. Pat. No. 3,411,394 discloses a tuning system for stringed instruments which independently anchors each string to a plate at the center, above, or below the pivoting axis. "Systems" include a bridge structure and a tuning device. In the Jones art, the plate is the tuning device. As the device is turned, the tension of each string is either increased, decreased, or unchanged; thereby raising, lowering, or unchanging the pitch of each string simultaneously. Spring balancing and movement limiting screws are disclosed for both directions.

Kaftan U.S. Pat. No. 4,170,161 discloses a tuning device for stringed instruments which independently anchors each string in the cavity of a rockshaft at the center, above, or below the pivoting axis. As the device is turned, the tension of each string is either increased, decreased, or unchanged; thereby raising, lowering, or unchanging the pitch of each string simultaneously. Kaftan also uses spring balancing and movement limiting screws. These features afford these vertically adjusting machines a wide variety of capabilities.

The invention herein specified is titled a pitch raising system because it can only raise the pitch of strings as opposed to the raising, lowering and unchanging capabilities of the prior art. The pitch raising device herein specified is longitudinally adjusted in a plane horizontal to the surface of the body of the guitar as opposed to the vertical adjustment of the prior art. Whereas the vertically adjusted tuning devices feature a wider variety of capabilities, this longitudinally adjusted pitch raising device overcomes many problems found in the prior art within its narrower scope.

OBJECTS

The main object of the pitch raising system is to provide mechanical means to produce musical techniques usually performed manually, including: (1) tremolo; (2) pitch raising; and (3) tremolo of raised pitches.

The following is a list of problems found in the prior art paired with an object of the invention herein specified.

Problem 1. The Turman (U.S. Pat. No. 2,949,806) and Scholz (U.S. Pat. No. 4,285,262) tremolo devices use springs. Certain embodiments of the Jones and Kaftan tuning devices also use springs. When using a spring, the problem naturally arises in maintaining an equilibrium between two counterbalancing forces: the force of the spring and the force of the strings. When the tension of any string changes, the spring cannot compensate without slightly allowing the device to move causing the attached strings to go out of tune.

Object 1. All tuning problems caused by counterbalancing and equilibrium have been eliminated by eliminating the spring. In the invention herein specified, the strings are the primary agent determining the resting position of the tuning device.

Problem 2. In the event that one of the movement limiting screws is used as a permanent stop for resting position, the handle comes to an abrupt stop when returning to resting position. The advantageous free up and down handle movement (as found in Turman and Scholz) is lost.

Object 2. A non-restricted free up and down movement of the handle is provided by eliminating any movement limiting screw in resting position.

Problem 3. Depending on the extremity of the tuning and depending on the rigidity of the machine, problems keeping the strings in tune can occur on account of slight flexing of the device as it rests on the movement limiting screw.

Object 3. The strings are kept in better tune in resting position because the movement limiting screw is eliminated in resting position.

Problem 4. The links found in prior art (Jones FIG. 10, #342 and Kaftan FIGS. 8, 9) break strings too easy.

Object 4. String breakage is reduced by utilizing a high wear resistant rod.

Problem 5. Slight detuning may occur when the guitarist pulls too hard on the handle. The tuning device slightly flexes against the upper movement limiting screw. (Jones, FIG. 7, #219, #219' and Kaftan, FIG. 4, #30, #38).

Object 5. The accuracy of tuning is improved in the raised position by positioning the upper stop above the handle. Now when the guitarist pulls too hard on the handle, the handle is slightly flexed and the tuning structure is less affected.

Problem 6. Normal bridges do not work well in conjunction with pitch changing devices. The string movement slowly cuts a notch at point of contact; and the resulting edges are abrasive enough to break strings often.

Object 6. String breakage on the bridge is reduced by utilizing a high wear resistant rod.

Problem 7. Jones describes floating bridges and Scholz recommends roller bridges. The problem with any movement of bridge parts is the absorption of string vibration which shortens note lengths. Even minute losses of sustain of note lengths are disliked by guitarists.

Object 7. Sustain loss is avoided by eliminating moving parts in the bridge structure.

Problem 8. Tremolo techniques requiring slight pitch change when the tuning device is in resting position are not easily performed on the vertically adjusted devices.

Object 8. Tremolo techniques in resting position requiring slight pitch change are easily performed because the rate of pitch change is much slower in resting position than in raised position and slower than the vertically adjusted devices in any position.

Problem 9. When the vertically adjusted devices are tuned to raise the pitch one whole step or larger, and the handle is unintentionally nudged, there is an adverse effect upon the music.

Object 9. Whenever the handle of the longitudinally adjusted device is unintentionally nudged, the adverse effect upon the music will be much less because the rate of change of pitch is so much smaller in resting position.

Different embodiments of this machine will have one or more or all of the above objects. Further objects and advantages of the invention will become apparent from a consideration of the drawings and ensuing description thereof.

Objects 8 and 9 are unobvious and require explanation; therefore, I exhibit the following cosine charts, equations, graph (FIG. 10) and discourse.

The Longitudinally Adjusted Pitch Raising Device

| Position | Degree | Cosine | Radius | X value | Change in X Value | Rate of Change |
|---|---|---|---|---|---|---|
| At rest | 0 | 1.0000 | 3 | 3 | | |
| | 1 | .9998 | 3 | 2.9994 | .0006 | slow |
| | 2 | .9994 | 3 | 2.9982 | .0012 | |
| | 3 | .9986 | 3 | 2.9958 | .0024 | |
| | 4 | .9976 | 3 | 2.9928 | .0030 | |
| | 5 | .9962 | 3 | 2.9886 | .0042 | |
| | 6 | .9945 | 3 | 2.9835 | .0051 | |
| | 7 | .9925 | 3 | 2.9775 | .0060 | medium |
| | 8 | .9903 | 3 | 2.9709 | .0066 | |
| | 9 | .9877 | 3 | 2.9631 | .0078 | |
| | 10 | .9848 | 3 | 2.9544 | .0087 | |
| | 11 | .9816 | 3 | 2.9448 | .0096 | |
| | 12 | .9781 | 3 | 2.9343 | .0105 | |
| Altered | 13 | .9744 | 3 | 2.9232 | .0111 | fast |

The Vertically Adjusted Tuning Devices

| Position | Degree | Cosine | Radius | X value | Change in X Value | Rate of Change |
|---|---|---|---|---|---|---|
| At rest | 77 | .2250 | .3413 | .0768 | | |
| | 78 | .2079 | .3413 | .0709 | .0059 | medium |
| | 79 | .1908 | .3413 | .0651 | .0058 | |
| | 80 | .1736 | .3413 | .0592 | .0059 | |
| | 81 | .1564 | .3413 | .0533 | .0059 | |
| | 82 | .1392 | .3413 | .0475 | .0058 | |
| | 83 | .1219 | .3413 | .0416 | .0059 | |
| | 84 | .1045 | .3413 | .0356 | .0059 | medium |
| | 85 | .0872 | .3413 | .0297 | .0058 | |
| | 86 | .0698 | .3413 | .0238 | .0058 | |
| | 87 | .0523 | .3413 | .0178 | .0059 | |
| | 88 | .0349 | .3413 | .0119 | .0058 | |
| | 89 | .0175 | .3413 | .0059 | .0059 | |
| Altered | 90 | .0000 | .3413 | .0000 | .0059 | medium |

The (x,y) coordinates for the points in FIG. 10 are:

B=(0,0)
H=(3,0)
D=(2.9232, y)
A=(0.0768, y)
C=(0, 0.3413)

The following equations hold true for FIG. 10:

$$\overline{AB}=\overline{CB}=0.3413''$$

$$\overline{DB}=\overline{HB}=3''$$

$$\angle CBA=\angle DBH=13°$$

$$\angle ABH=77°$$

$$\angle CBH=90°$$

DISCOURSE ON OBJECTS 8 AND 9

The technical difference between the vertically adjusted devices of the prior art and the longitudinally adjusted pitch raising device is the "rate of change" in pitch as the device is moved from resting position to its altered position.

In FIG. 10 in which both devices are identically tuned (E', A & D strings unchanged and G, B & E strings up one whole step), this technical difference can be mathematically demonstrated. The longitudinally adjusted device is represented by line $\overline{BH}$ in resting position and line $\overline{BD}$ in altered position. The physical structure of the vertically adjusted devices are represented by line $\overline{AF}$ in resting position and by line $\overline{CG}$ in altered position. Because there will be no lowering of notes in the vertically adjusted device in this example, all points of attachment of the strings will be within line segments $\overline{AB}$ and $\overline{CB}$ in the first quadrant.

Each device is altered the same number of degrees (13°) for fair comparison on the same turning point (B). Depending upon the adjustment of the movement limiting screws, the vertically adjusted devices' movement of 13° could occur in the first quadrant, the second quadrant, or any range of 13° divided between both quadrants. For an easy reading of the cosine charts, I chose it to move in the first quadrant only (from 77° to 90°). The longitudinally adjusted device uses a 3" radius for a high E string (also known as the first string). The high E string will raise to a F# pitch (up one whole step) with a 13° movement (the FIGS. 3" and 13°, are closely approximated for sake of illustration).

To get both machines in equal adjustment for fair comparison, the E string must be pulled backward the same distance for each machine. The difference between the x values of points D and H must equal the difference between the x values of points C and A. The x value of point D is found by equation:

$$x=(\cos\angle)(\text{radius})$$

The difference between the x values of points H and D is:

$$3-2.9232=0.0768''.$$

The difference between the x values of points C and A must also equal 0.0768". The x value of point C is 0; therefore, the x value of point A must equal 0.0768". The radius at point A can now be found using:

$$x=(\cos\angle)(\text{radius}).$$

Compare the "change in x values" columns (which indicate change in pitch) in the cosine charts. The vertically adjusted devices have a constant change in pitch per degree of movement contrasting the longitudinally adjusted device having an accelerating change in pitch as it moves from resting position. The change in pitch for tremolo in the resting position is smaller per degree than that in the vertically adjusted devices.

DESCRIPTION OF STRUCTURE

Figure 1:
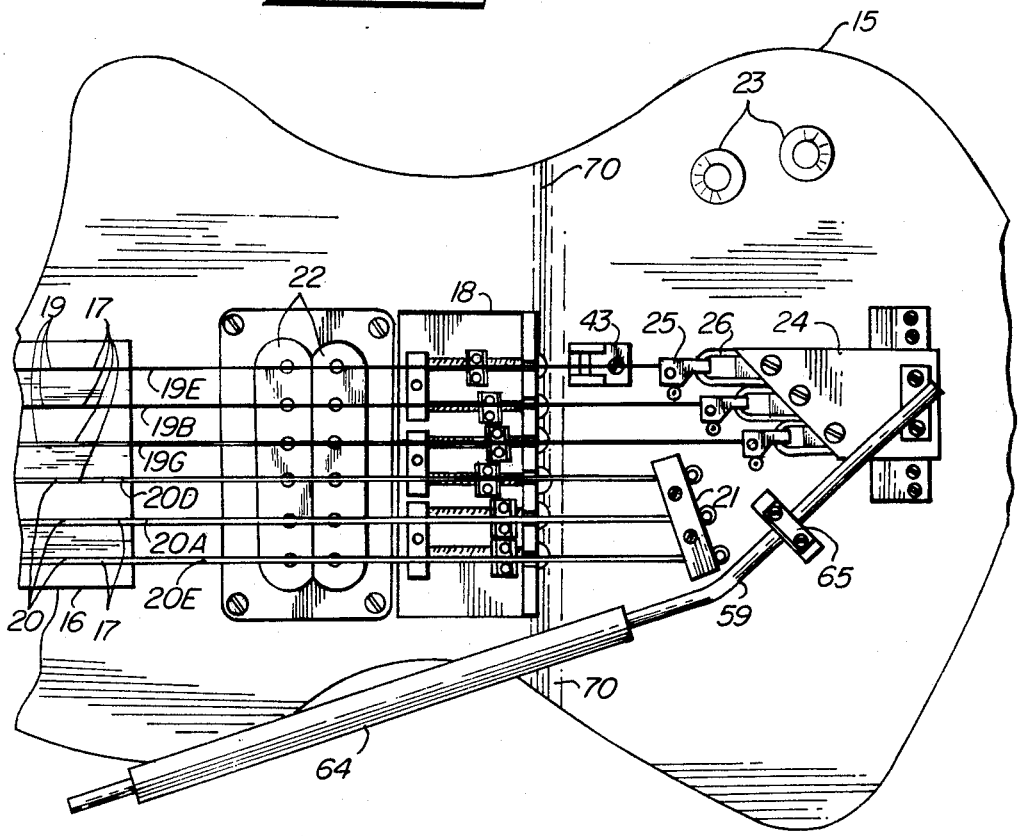
FIG. 1 is a fragmentary top view of a guitar incorporating an embodiment of the invention.

The best mode of the invention is described physically as follows:

FIG. 1 shows the invention in an electric guitar having a body 15. A neck 16 extends from the body 15 and terminates in a head (not shown) having tuning pegs or other means to which the ends of the strings 17 are attached. The strings 17 extend rearwardly from the head, over a nut, over the neck 16 and then over a bridge structure 18. The pitch raising device is secured to the instrument rearward of the bridge. The three non-wound (or plain) high strings 19E, 19B and 19G (in which the letter suffix corresponds to the normal string pitch) are attached to the pitch raising device. The device is tuned to raise each attached string 19 upward one whole step. The three lower wound strings 20D, 20A and 20E' are mounted to the body 15 by tailpiece 21.

There are two electromagnetic pickup units 22 mounted to the body 15 below the strings 17. The guitar includes a number of control knobs, switches, etc. 23, outlet jacks (not shown) and like electric devices which are typically found in electric guitars.

The central part of the pitch raising device is the pivoting structure 24; it is pulled taut by the attached strings 19 approximately horizontal to the surface of the body 15.

Figure 2:
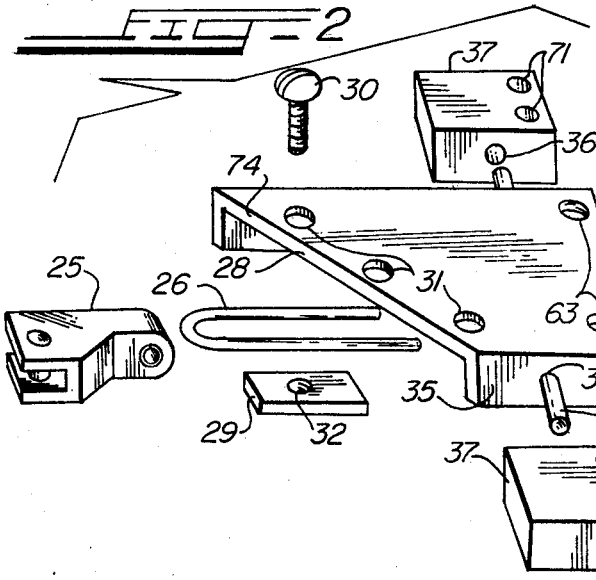
FIG. 2 is a fragmentary exploded view of an embodiment of a pitch raising device.

FIG. 2 is an exploded view of the parts needed to attach one string 19E to the pitch changing device. The string 19E is anchored in the link 25; the link 25 is joined to the U-shaped rod 26 by the joining hole 27; the U-shaped rod 26 is held tight between the bottom of the plate 28 of the pivoting structure 24 and the clamp 29; the clamp 29 is held by a screw 30 which goes through a hole 31 in the pivoting structure 24 and threads into a hole 32 in the clamp 29.

A pivoting rod 33 is pressed into the holes 34 in the sidewalls 35 of the pivoting structure 24 and turns in the holes 36 of the mounting blocks 37. The center line of the pivoting rod 33 is the axis of the pivoting structure 24 as recited in claim #1a.

Figure 3:
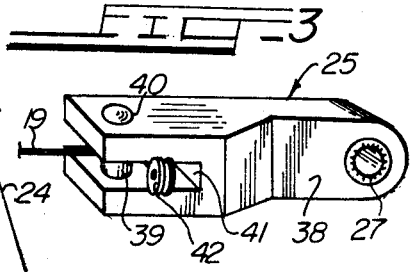
FIG. 3 is a perspective view of an embodiment of a link.

In FIG. 3 the rearward end 38 of the link 25 is milled thinner and rounded off around the hole 27 to allow free movement on the U-shaped rod 26. The hole 27 is countersunk on each side also for free movement. A link rod 39 is pressed into a hole 40 and extends through the entire link 25. A slot 41 is milled through the forward end of the link 25.

To attach the strings 19 to the links 25, insert one into the slot 41 and bend it around the link rod 39 passing over its round surface making about a 90° turn. The ball 42 secured to the tail end of the string 19 is too large to fit through the slot 41 thereby anchoring the string 19. The link rod 39 provides a grip point whereupon the strings 19 cease stretching. The string 19 is attached to the pivoting structure 24 by means of the link 25.

To align the points of attachment in a single geometric plane which also contains the pivoting structure's 24 axis, strictly follow these specifications:

(1) the diameter of the pivoting rod 33 and the U-shaped rods 26 must be equal;

(2) just as the U-shaped rods 26 touch the bottom of the plate 28, the holes 34 must be drilled into sidewalls 35 so that the pivoting rod 33 also touches the bottom of the plate 28;

(3) the U-shaped rods 26 must be made out of strong material which will not bend.

The geometric plane lies below and parallel to the plate 28 at a distance of ½ the diameter of the pivoting rod 33.

Figures 4, 10, 11:
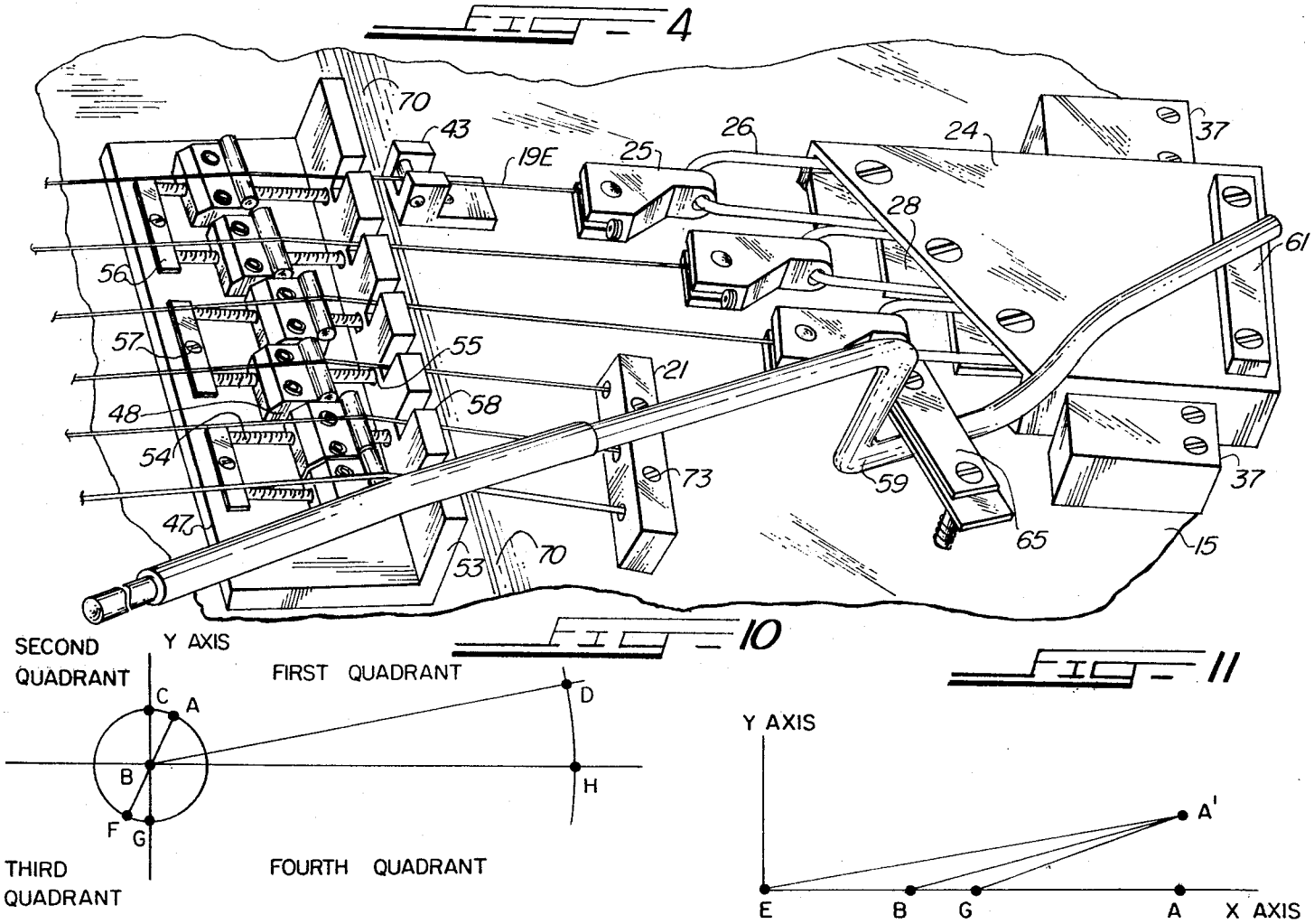
FIG. 4 is a perspective view of an embodiment of the invention.
FIG. 10 graphs the movement of both the longitudinally adjusted pitch raising device and the vertically adjusted tuning device.
FIG. 11 graphs the side view of the geometric plane of the pitch raising device (line $\overline{EA}$). It also graphs the dispersion of direction of the force from the strings onto the axis when the axis is moved out of the geometric plane to point A'.
Figure 5:
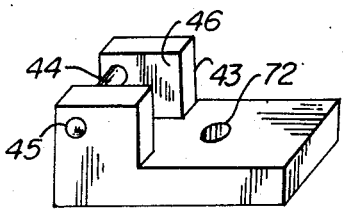
FIG. 5 is a perspective view of an embodiment of a string resting element.

As seen in FIG. 4 a string rest element 43 is placed between the pivoting structure 24 and the bridge structure 18 for string 19E. A string rest rod 44 is pressed in the hole 45 crossing the milled slot 46 (FIG. 5).

Figure 6:
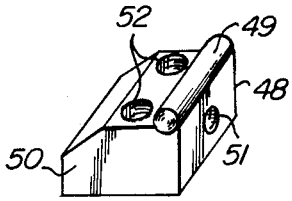
FIG. 6 is a perspective view of an embodiment of a bridge element.

The guitar has a bridge structure 18 near the center of the body 15 having a bridge plate 47 and six bridge elements 48 (FIG. 4). Each bridge element 48 has a bridge rod 49 welded to the top of the bridge base 50 (FIG. 6). This bridge rod 49 has a round surface for the strings 17 to pass over. The bridge rod 49 for string 19E and the string rest rod 44 are polished with diamond compound up to 14,000 mesh equivalent. Each bridge base 50 has a threaded hole 51 for longitudinal adjustment and two threaded holes 52 in the top for vertical adjustment (use headless set screws).

As seen in FIG. 4, a bridge back 53 is welded at a 90° angle to the bridge plate 47. Six screws 54 enter through the holes 55 in the bridge back 43. The screws 54 then thread through the holes 51 of the bridge bases 50 and are held down tight in pairs by three bridge clamps 56. Screws 57 fit through the center of the bridge clamps 56 and screw into threaded holes in the bridge plate 47. Alignment slots 58 are milled in the bridge back 53 to keep the strings 17 evenly spaced.

To make a tailpiece 21 for anchoring the strings 20D, 20A and 20E', three holes are drilled into a small piece of square steel.

Figure 7:
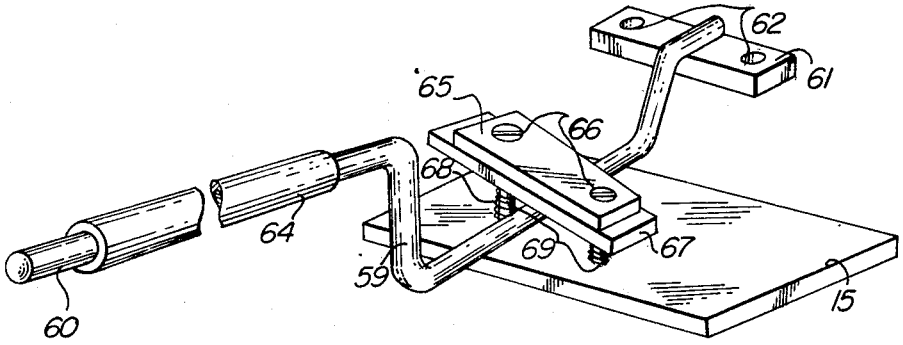
FIG. 7 is a perspective view of an embodiment of a handle and an upper stop assembly.

FIG. 7 illustrates the handle 59 for the pitch raising device and its upper stop. The handle 59 is a rod 60 with a mounting strip 61 welded on having two holes 62. The holes 62 are lined up with the threaded holes 63 in the pivoting structure 24; and the handle 59 is screw mounted. A foam rubber tube 64 is slid over the handle rod 60.

The upper stop assembly comprises: a blocking element 65 which is a strip of steel having two holes 66, a rubber strip 67 having two holes spaced equally with the blocking element holes 66, two compression springs 68 and two wood screws 69. To assemble, first slide the blocking element 65 on the two wood screws 69 through the holes 66. Then slide on the rubber strip 67, and then slide on the two compression springs 68 one on each screw. Then place a wood screw 69 on each side of the rod 60 of the handle 59 and screw into the body 15.

On the rearward side of the bridge structure 18, the body 15 of the guitar slants about 10° downward illustrated by curve 70 FIG. 4

Materials: The materials used for the best mode of the invention are: stainless steel for the pivoting rod 33, the U-shaped rod 26, the handle rod 60 and the bridge base 50; brass for the bridge plate 47, bridge back 53 and links 25 and mounting blocks 37; spring steel for the bridge clamps 56; tungsten carbide ($\frac{1}{8}$" diameter) for the link rod 39, the bridge rod 49 and the string resting rod 44.

Mounting: Use wood screws to mount the following parts to the body 15 of the guitar: the mounting blocks 37 by holes 71, the string rest element 43 by hole 72, the tailpiece 21 by holes 73 and the bridge plate 47.

Tuning: When the clamp screws 30 are loosened, the U-shaped rods 26 can move longitudinally forward and backward on a line perpendicular to the axis. Follow these steps to tune the pitch raising device:

(1) Push the U-shaped rod 26 for string 19G all the way back toward the axis.
(2) Adjust the blocking element 65 to tune string 19G to an A pitch in raised position.
(3) Adjust the U-shaped rod 26 to tune string 19B to a C# note in raised position. If the raised note is above C#, move the U-shaped rod 26 backward (toward the axis); if the raised note is below C#, move the U-shaped rod forward (away from the axis).
(4) Adjust the U-shaped rod 26 to tune string 19E to a F# in raised position.

DESCRIPTION OF FUNCTIONS

The best mode of the invention is described functionally as follows:

The function of the pivoting structure 24 is to provide sturdy means for increasing the tension of the attached strings 19E, 19B and 19G. As the pivoting structure 24 turns on the pivoting rod 33 it pulls the attached strings 19 tighter causing the pitch of the musical notes to ascend.

The sidewalls 35 not only add strength to the plate 28; but they hold the U-shaped rods 26 and clamps 29 in line during adjustment. The plate 28 is longer on the front side 74 for string 19E than for string 19G because more pressure is needed to raise string 19E one whole note than to raise string 19G one whole note.

The function of the links 25 is to provide a means of attachment for the strings 19 which substantially reduces wear on a string. The link rods 39 surface will remain round and not give way to abrasive edges due to wear. The function of the longitudinally adjustable U-shaped rod 26 is to hold the link 25 at the desired distance from the pivoting structure's 24 axis. The screws 30 and clamps 29 hold the U-shaped rods 26 on the pivoting structure 24. The mounting blocks 37 hold the pivoting structure 24 to the body 15.

The geometric plane directs all attached strings 19 to pull the pivoting structure 24 in unison from one direction to the one same resting position. To illustrate the function of this singular plane, the side view of the plane of the invention is graphed as line $\overline{EA}$ in FIG. 11. Point A is the axis and points E, B & G are the points of string attachment. Within the scope of this side view, notice that the force of each attached string 19 pulls from the same direction.

To contrast, the axis is moved upward to point A'. Physically, this would mean the pivoting rod 33 would be attached to the top of the pivoting structure 24. Lines $\overline{EA'}$, $\overline{BA'}$ and $\overline{GA'}$ represent the side views of three different planes. The force of each attached string 19 now pulls from a slightly different direction. The resting position of the pivoting structure 24 fluctuates somewhere to the middle of these three directions causing tuning problems.

The strings 17 must always retain enough pressure on the bridge elements 48 so that a strong musical tone rings without irritating buzzing of the strings. Because the horizontal pitch raising device raises the string 19 upward as well as backward, the unit must be lower than normal to compensate for this lifting. For this reason, the body 15 bends 10° downward at curve 70 toward the rear.

Even though only about 10° to 12° of string angle on the bridge element 48 is needed for firm contact, this embodiment has about 16°. Special attention has been given to string 19E because this string must endure high tension. The function of the string resting element 43 is to decrease the angle of string 19E over bridge element 48 from about 16° to about 10°. String breakage on the bridge rod 49 is thereby reduced. By moving the string 19E slightly upward the direction of the string 19E toward the pivoting structure changes about $\frac{1}{2}$°. As string 19B and 19G counteract this change, the pivoting structure is altered less that $\frac{1}{4}$°. The strings 19 are the primary agent determining the resting position of the pivoting structure 24, and the string resting element 43 is a minor agent.

The bridge element 48 provides bridging for the strings 17 and can be longitudinally adjusted for proper intonation of pitch along the neck 16. It can also be vertically adjusted for easier string manipulation along the neck 16 (playability). The bridge rod 49 provides a round surface which will not develop abrasive edges from the wear of string friction.

The bridge plate 47 provides a smooth surface and dense support for the bridge elements 48. The bridge back 53 spaces the strings 17 evenly by alignment slots 58. The bridge clamps 56 prevent the bridge elements 48 from rattling and reduce bridge vibration which cancels string vibration and thereby shortens note length.

The handle 59 is bent high enough from the surface of the guitar so that the picking hand of the musician fits underneath it. The handle 59 is pushed upward by the back of the hand thereby turning the pivoting structure 24. A foam rubber tube 64 is recommended for comfort.

The blocking element 65 limits the extent of movement of the handle 59 and thereby limits the upward movement of the pitch of the musical notes. The two wood screws 69 not only mount the blocking element 65 to the body 15; but they adjust the blocking element 65 to the proper height above the handle 59 thereby adjusting the extent of turning of the pitch changing device. The rubber strip 67 prevents noise between the handle 59 and blocking element 65.

OTHER EMBODIMENTS

Figure 9:
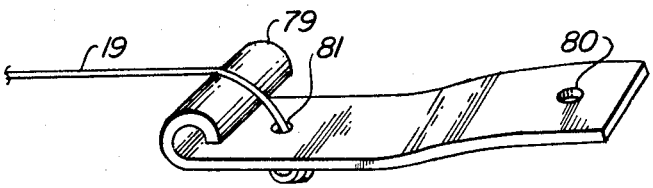
FIG. 9 is a perspective view of an alternative embodiment of a link.

While the above description contains many specificities, these should not be construed as limitations on the scope of the invention, but rather as an exemplification of one preferred embodiment thereof. Many other variations are possible, for example:

To adapt the invention to a flat surfaced guitar, rollers must be placed rearward of the bridge to keep the strings in firm contact with the bridge rods 49. An example of these rollers can be found in Jones, FIG. 9. The rollers influence the direction of the strings 19 as they approach the pivoting structure 24. The strings 19 are the primary agent determining the resting position of the pivoting structure 24; and these rollers are a secondary agent because of their influence on the strings 19. Without rollers the bridge would be a secondary agent.

Figure 8:
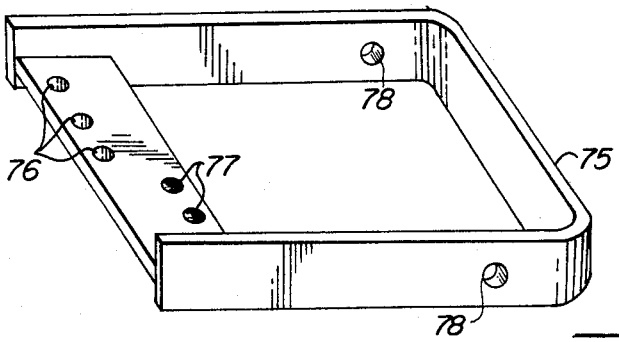
FIG. 8 is a perspective view of an alternative embodiment of a pivoting structure.

The invention may be adapted for tremolo units not offering pitch raising features. The pivoting structure 24 will be comprised of a pivoting frame 75 instead of a plate 28. In FIG. 8 this weaker structure has holes 76 for attaching the U-shaped rods 26, threaded holes 77 for mounting the handle 59 and holes 78 for turning on a pivoting rod.

Other embodiments of the invention could include: (1) means for attaching all six strings of which none are longitudinally adjustable; (2) string fastening means other than links; and (3) screw means for adjusting the U-shaped rods. and (4) other pivotal means replacing the pivoting rod 33 (such as a very short rod extending from each mounting block).

The claimed bridge element would also be effective and useful for guitars not employing pitch changing devices. Other embodiments of the bridge element include: (1) individual bridge clamps for each bridge element; (2) using only one vertical adjustment screw; (3) using other means besides screw for longitudinal adjustment; (4) pressing the rod into the bridge base instead of welding.

A strip of material (preferably tool steel for the purpose of tempering) is shaped at one end forming an elevated round surface 79 for the strings 19 to pass over. This strip is joined to the pitch changing device by hooking the U-shaped rod 26 through the joining hole 80. The string 19 is anchored by the hole 81 which is too small for the ball 43 of the string 19 to pass through.

Another embodiment of a link would have its link rod attached by means of welding instead of pressing.

There are many other variations of the invention that are not listed here. The scope of the invention should be determined not by the embodiment illustrated, but by the appended claims and their legal equivalents.

I claim:

1. A pitch altering device for a stringed musical instrument having a bridge and a plurality of strings, said pitch altering device comprising:

a pivoting structure pivotally secured to said instrument rearward of said bridge about a pivot axis disposed transverse to said strings;

means for attaching a plurality of strings to said pivoting structure, said attached strings being the primary agent determining the resting position of said pivoting structure, the points of attachment lying in a plane passing through said axis and being spaced from said axis in the direction of the respective string's length when said string is tensioned on said instrument such that the relative tuning of the attached strings is substantially maintained when said pivoting structure is pivoted about said axis, said attaching means and said pivoting structure rigidly maintaining said plane during pivoting; and means for pivoting said pivoting structure about said axis to alter the tension of the attached strings simultaneously.

2. The pitch altering device of claim 1 wherein said attaching means includes means for adjusting the respective attachment points linearly in the direction of said respective string's length.

3. The pitch altering device of claim 2 wherein said instrument is a guitar and said pivoting structure is a tailpiece.

4. The pitch altering device of claim 3 wherein said pivoting means is a rod having one end connected to said tailpiece and an opposite end disposed for actuation by the player of the guitar.

5. The pitch altering device of claim 6 further including stop means contacting said rod to limit the extent of pivoting movement of said pivoting structure.

6. The pitch altering device of claim 5 wherein said stop means is adjustable.

7. The pitch altering device of claim 6 wherein said adjustable stop means permits the pitch of said attached strings to be altered one whole step when said rod is moved into contact with said stop means.

* * * * *